US009765539B2

(12) United States Patent
Laures et al.

(10) Patent No.: US 9,765,539 B2
(45) Date of Patent: Sep. 19, 2017

(54) CONCRETE FORM PANEL AND A FASTENING SYSTEM AND METHOD FOR FASTENING FORM HARDWARE ON THE CONCRETE FORM PANEL

(71) Applicant: Western Forms, Inc., Kansas City, MO (US)

(72) Inventors: Brian Laures, Platte City, MO (US); Roman Brewka, Saint Joseph, MO (US); Carlton P. Kenney, Kansas City, MO (US); Ronald Ward, Leawood, KS (US)

(73) Assignee: Western Forms, Inc., Kansas City, MO (US)

( * ) Notice: Subject to any disclaimer, the term of this patent is extended or adjusted under 35 U.S.C. 154(b) by 152 days.

(21) Appl. No.: 14/808,912

(22) Filed: Jul. 24, 2015

(65) Prior Publication Data

US 2017/0022724 A1 Jan. 26, 2017

(51) Int. Cl.

| | |
|---|---|
| ***E04G 17/00*** | (2006.01) |
| ***E04G 17/04*** | (2006.01) |
| ***E04G 17/14*** | (2006.01) |
| *E04G 9/02* | (2006.01) |

(52) U.S. Cl.
CPC ..... *E04G 17/002* (2013.01); *E04G 17/04* (2013.01); *E04G 17/14* (2013.01); *E04G 2009/028* (2013.01)

(58) Field of Classification Search
CPC ..... E04G 19/003; E04G 11/06; E04G 17/002; E04G 17/14; E04G 17/04; E04G 2009/028
See application file for complete search history.

(56) References Cited

U.S. PATENT DOCUMENTS 5,174,909 A * 12/1992 Ward ..... E04G 17/04 249/166
5,655,674 A * 8/1997 Holztrager ..... A47F 5/0846 211/87.01
D613,520 S * 4/2010 Goodman ..... D25/138

* cited by examiner

*Primary Examiner* — John C Hong
(74) *Attorney, Agent, or Firm* — Hovey Williams LLP

(57) ABSTRACT

A method and fastening system for fastening to a concrete form panel various types of form hardware, including pins, form ties and various types of brackets and attachments for wall braces, scaffolds, and lanyards to a concrete form panel. The concrete form panel includes a track system that forms part of the fastening system. A base associated with the form hardware may be interconnected with the track system to allow selective positioning of the form hardware along a longitudinal length of the track system.

5 Claims, 18 Drawing Sheets

CONCRETE FORM PANEL AND A FASTENING SYSTEM AND METHOD FOR FASTENING FORM HARDWARE ON THE CONCRETE FORM PANEL

FIELD

The present invention relates to concrete form panels used for assembling forms for poured concrete walls and other structures. More particularly, the present invention relates to a fastening system and method for selectively positioning and selectively securing various form hardware on the concrete form panels, including for the purpose of securing together adjacent concrete form panels.

BACKGROUND

Concrete forms used for foundation and other wall construction are normally comprised of multiple concrete form panels that are releasably secured together, side-by-side and/or end-to-end using various types of fasteners that extend through aligned holes in the siderails or endrails of adjacent concrete form panels. The fasteners have also been used to secure various other types of forming hardware to the concrete form panels. Examples of such other forming hardware include form ties and various types of brackets and attachments for scaffold supports, wall braces, lanyards, pins and the like.

Many different types of fasteners have been used for these purposes, such as bolts and nuts, hinged latches, and pins and wedges. More recently, fasteners have been used that are in the form of engagement pin mechanisms in which the bolts or pins extend or slide along an attachment base that is permanently-fixed to a face of the concrete form panel adjacent the siderail or endrail.

These types of engagement pin mechanisms generally include a base or bracket that is permanently attached, such as by welding, to the concrete form and an engagement pin that is directly or indirectly coupled with the base or bracket and may be manually extended through the aligned apertures in the siderails or endrails of adjacent concrete form panels to maintain the adjacent concrete form panels in alignment. In some embodiments, a wedge is driven through the slot to prevent retraction of the engagement pins. In other embodiments, a latch carried by the engagement pin is engaged to hold the siderails or endrails together to prevent separation of the adjacent concrete form panels. Examples of the latching-type engagement pin mechanisms are described in U.S. Pat. Nos. 5,058,855 and 5,174,909.

While the use of these engagement pin mechanisms has greatly facilitated the joining and subsequent separation of adjacent concrete form panels, welding a dozen or more individual bases or mounting brackets to each panel is time-consuming and increases the fabrication cost of the concrete form panel. This conventional approach of permanently securing the base or bracket at a fixed location on the concrete form panel is also problematic when the form has multiple closely-spaced apertures in the siderails and endrails that are designed to allow the fastener to be positioned through whichever aperture provides the optimal load distribution for the specific forming application. If fixed fasteners are to be used with these closely-spaced apertures, the apertures must be spaced apart a sufficient distance to provide the necessary clearance for placement and operation of the fasteners. The fabrication costs of the panel are also increased by the use of additional fixed fasteners, or their mounting brackets, that are dedicated to each of the closely-spaced apertures. In addition, because the fixed fasteners must be placed closely adjacent the siderails or endrails, the various types of form hardware that are mounted on the fixed fasteners must also be position at those same locations even though placement at another location on the concrete form panel may be necessary or more desirable. A need has thus developed for improved concrete forming panels and an improved system and method of mounting fasteners and other form hardware to the concrete forming panels.

SUMMARY

In one aspect, the present invention is directed to a method of securing form hardware to a concrete form panel. The method comprises the steps of providing a track system associated with a rear face of the concrete form panel opposite from a front forming face of the concrete form panel. The track system has a longitudinal length and is spaced from an endrail or siderail of the concrete form panel. The method includes the step of interconnecting the form hardware with said track system at any of a multiple number of selected locations along the longitudinal length of the track system.

In another aspect, the present invention is directed to a concrete form panel having a front forming face, an opposite rear face, siderails extending along sides of the concrete form panel, endrails extending along ends of the concrete form panel, and a track system for securing form hardware to the concrete form panel. The track system has a longitudinal length and is spaced from an endrail or siderail of the concrete form panel.

In a further aspect, the present invention is directed to a form fastening system for fastening a concrete form panel to an adjacent concrete form panel. The concrete form panel has a siderail that presents an aperture. The form fastening system comprises an engagement pin mechanism that includes an engagement pin configured to selectively extend through the aperture to fasten the concrete form panel to the adjacent concrete form panel, and a base associated with the engagement pin. The base has a locking plate, which has a flange that is oriented perpendicular to an axis of the engagement pin. The form fastening system also includes a track system associated with an outer surface of the concrete form panel and extending parallel to and spaced apart from the rail. The track system has a groove configured to receive the flange of the locking plate to thereby secure the engagement pin mechanism in a location on the track system such that the engagement pin is positioned to extend through the aperture in the siderail. The locking plate is reorientable within the track system such that in a first orientation, the engagement pin mechanism is not secured in the location on the track system, and in a second orientation, the flange is tightly received within the groove so that the engagement pin mechanism is secured in the location on the track system.

In a still further aspect, the present invention is directed to a fastening system for fastening form hardware to a concrete form panel having a front forming face, an opposite rear face, siderails extending along sides of the concrete form panel, and endrails extending along ends of the concrete form panel. The fastening system comprises a track system associated with the rear face of the concrete form panel and having a longitudinal length and a base associated with the form hardware and constructed for interlocking with the track system to allow selective positioning of the form hardware along the longitudinal length of the track system.

This summary is not intended to identify essential features of the present invention, and is not intended to be used to limit the scope of the claims. These and other aspects of the present invention are described below in greater detail.

DRAWINGS

In the accompanying drawings that form a part of the specification and are to be read in conjunction therewith and in which like reference numerals are used to indicate like parts in the various views.

Figure 1:
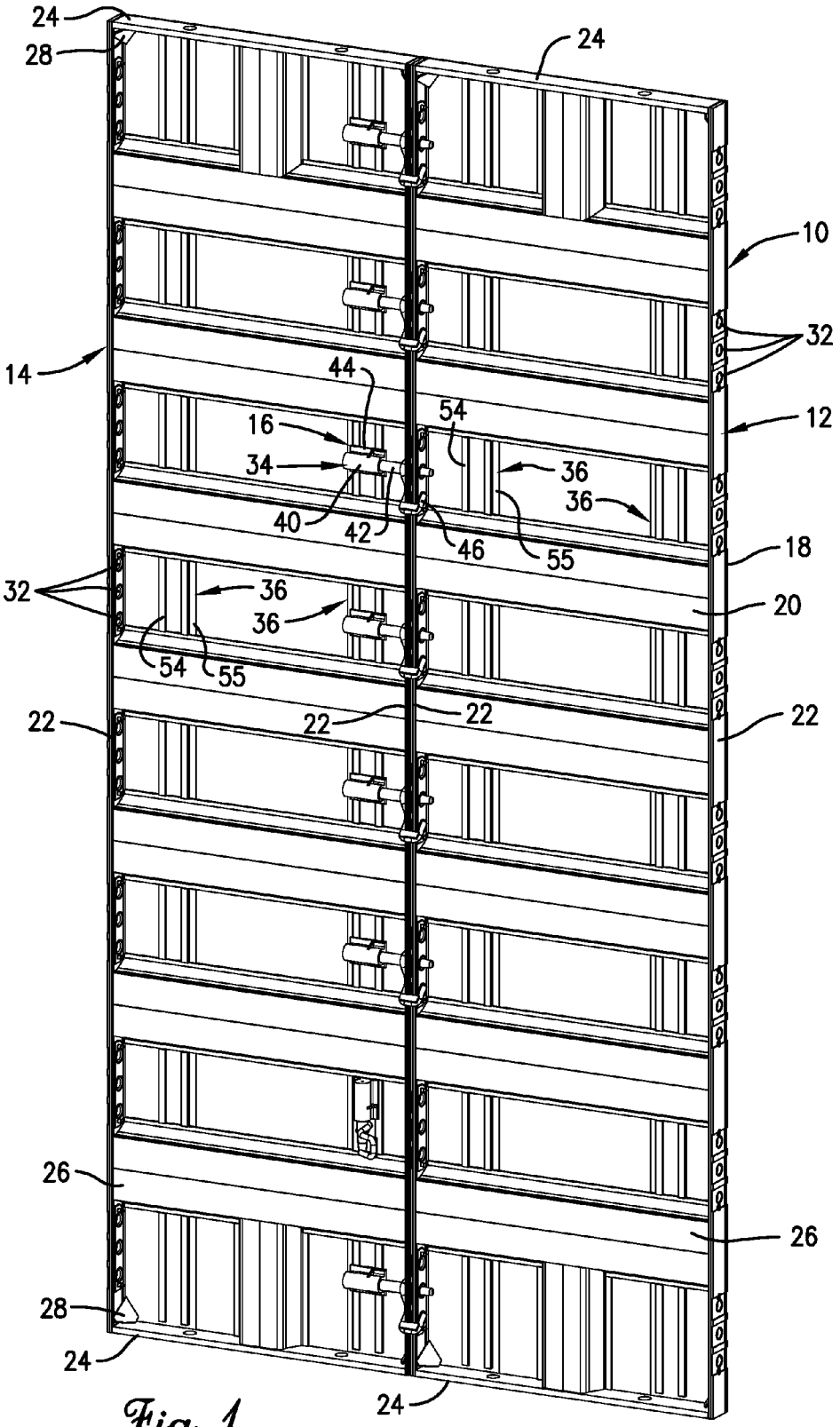
FIG. 1 is an rear elevation view of an exemplary concrete form comprising first and second concrete form panels, wherein the first and second concrete form panels are fastened together by an embodiment of a fastening system of the present invention.

The drawing figures are not intended to limit the present invention to the specific embodiments they depict. The drawings are not necessarily to scale.

DETAILED DESCRIPTION

Figure 2:
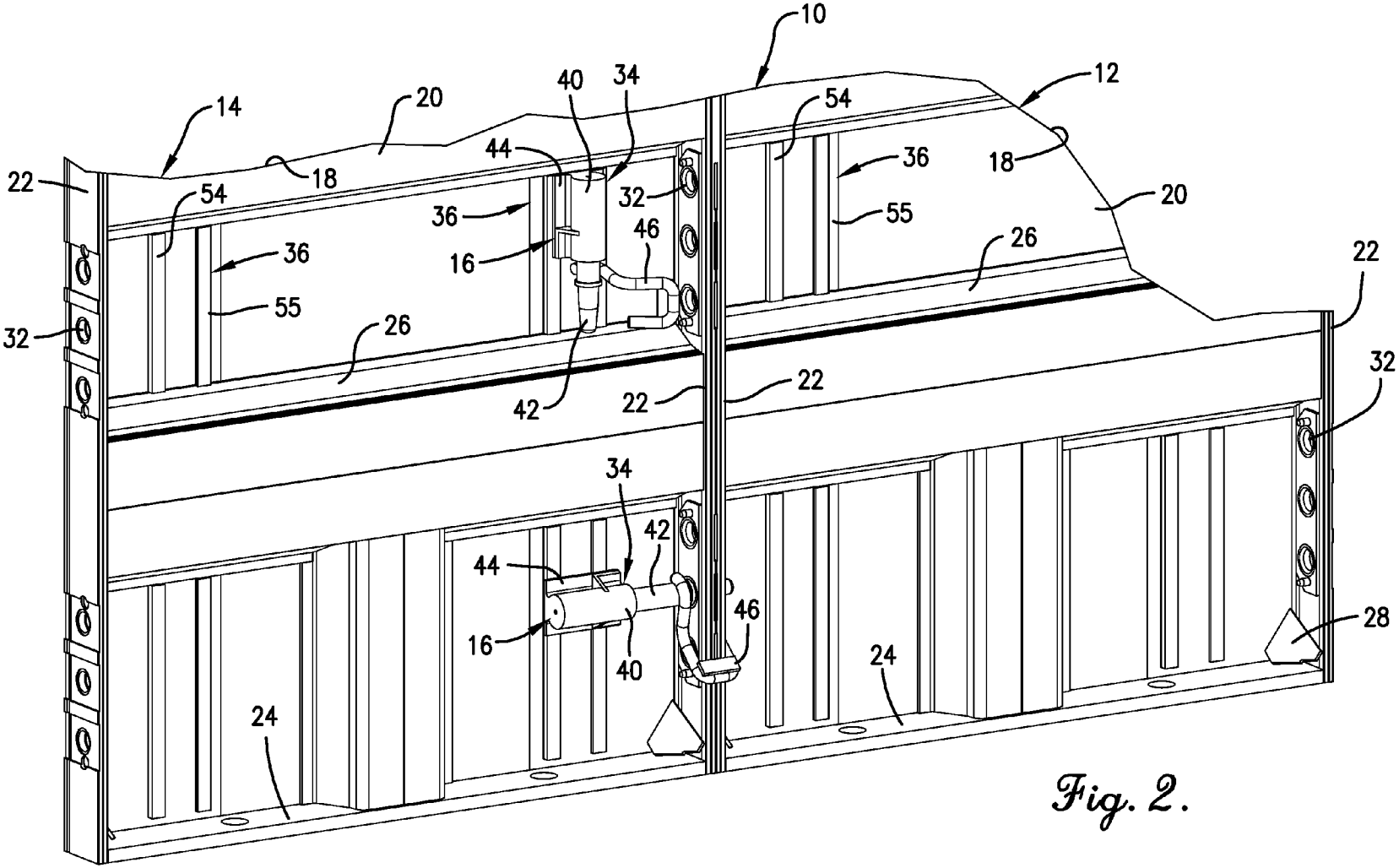
FIG. 2 is an enlarged, fragmentary, rear perspective view of the concrete form of FIG. 1 showing the fastening system with an engagement pin mechanism in locking engagement with a track system housing and a second engagement pin mechanism oriented in preparation for being secured with the track system.
Figure 3:
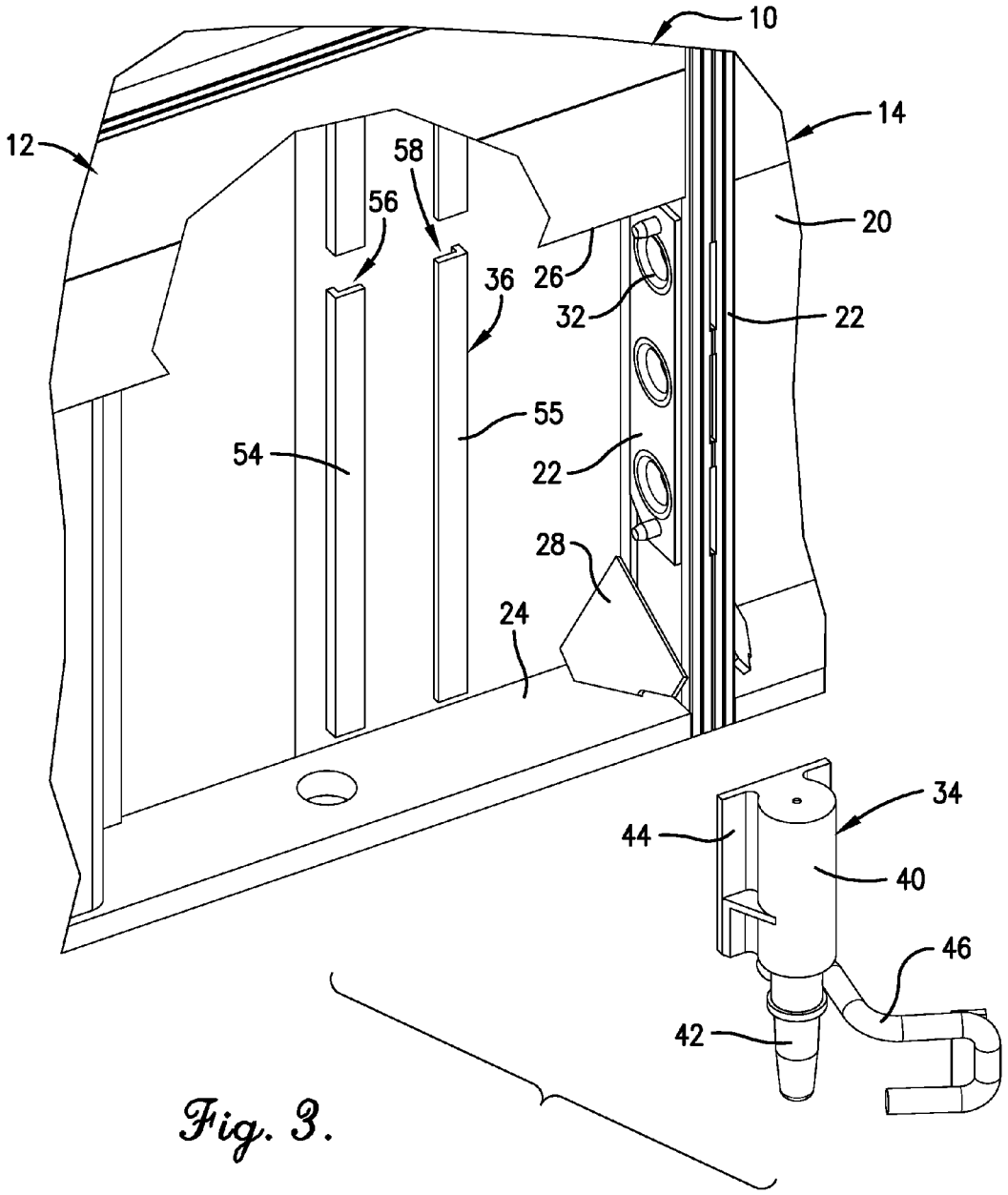
FIG. 3 is an exploded, fragmentary perspective view of the concrete form of FIGS. 1 and 2 showing the engagement pin mechanism disengaged from the track system.
Figure 4:
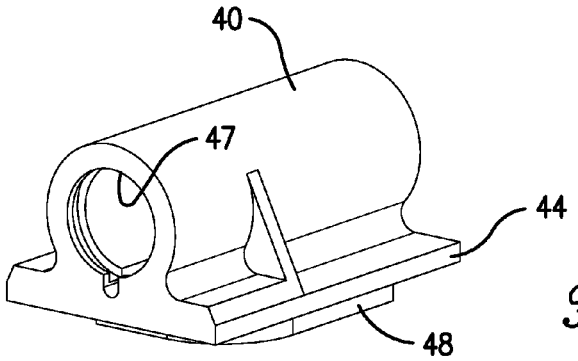
FIG. 4 is an enlarged perspective view of a housing of the engagement pin mechanism.
Figure 5:
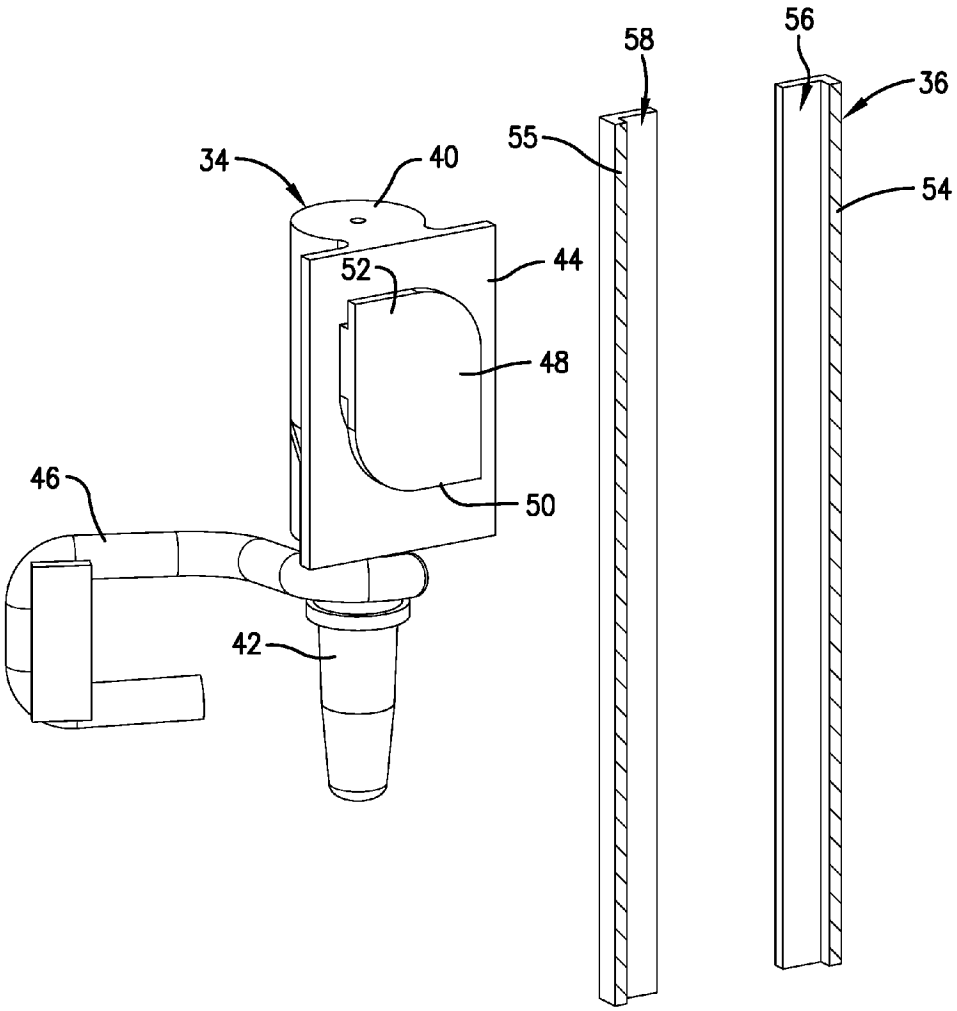
FIG. 5 is an exploded perspective view of the concrete form showing the engagement pin mechanism and track system from the opposite direction of the views shown in FIGS. 1-3.

Referring now to the drawing figures in greater detail and initially to FIGS. 1 and 2, an embodiment of a concrete form that may be configured to receive viscous concrete or other poured material and maintain the concrete in a desired shape until the concrete sets is represented broadly by the numeral 10. The concrete form 10 includes a concrete form panel 12 selectively fastened to an adjacent concrete form panel 14 by a fastening system 16 of one embodiment of the present invention.

Each concrete form panel 12, 14 is rectangular in shape and includes a front forming face 18, an opposite rear face 20, opposed siderails 22 that extend vertically along the major side dimension of the concrete form panel 12, 14, and siderails that extend horizontally along the minor side dimension and are also referred to herein as endrails 24. The front forming face 20 may be smooth or patterned. Each concrete form panel 12, 14 may further include one or more ribs 26, gussets 28 and/or other reinforcing structures, typically located on the rear face 20. Each of the siderails 22 and, optionally the endrails 24, includes a plurality of spaced-apart apertures 32 (best seen in FIG. 2).

Referring additionally to FIGS. 3-11, the fastening system 16 is configured to selectively fasten the concrete form panel 12 to the adjacent concrete form panel 14. The fastening system 16 includes an engagement pin mechanism 34 that is releasably engageable with a track system 36 at multiple locations along a longitudinal length of the track system 36. The engagement pin mechanism 34 includes a housing 40, an engagement pin 42 associated with the housing 40, a base 44 from which the housing 40 extends, and a latch 46 carried by the engagement pin 42.

The housing 40 is substantially cylindrical with a central bore 47 oriented along an axis. The housing 40 may be made of any suitable material, such as one or more metals, metal alloys, or polymers. The engagement pin 42 is configured to be slidably received within the bore 47 of the housing 40 so as to be selectively extendable along the axis for insertion through the aligned apertures 32 of the siderails 22 or endrails 24 of the concrete form panels 12, 14. The engagement pin 42 has a diameter sized so that it is tightly received in the aligned apertures 32, thereby preventing the concrete form panels 12, 14 from shifting in relation to each other. Once the engagement pin 42 is in place, the latch 46 is rotated to capture and prevent separation of the abutted siderails 22 or endrails 24 of the concrete form panels 12, 14.

The engagement pin 42 and latch 46 may be made of metal or substantially any other suitable material.

The base 44 is configured to selectively engage the track system 36 in order to selectively secure the engagement pin mechanism 34 at a location on the outer surface 20 of the concrete form panel 12 such that the engagement pin 42 is aligned with the aperture 32 in the siderail 22 or endrail 24. The base 44 may be constructed of suitable material, such as one or more metals, metal alloys, or polymers. The base 44 may be formed integrally with the housing 40 or it may be formed separately and then joined to the housing 40 in a suitable fashion. In one embodiment, the base 44 includes a locking plate 48 having parallel flanges 50, 52, which may be oriented approximately perpendicular to the axis of the central bore 47 of the housing 40 and the engagement pin 42 slidably received therein.

Figure 20:
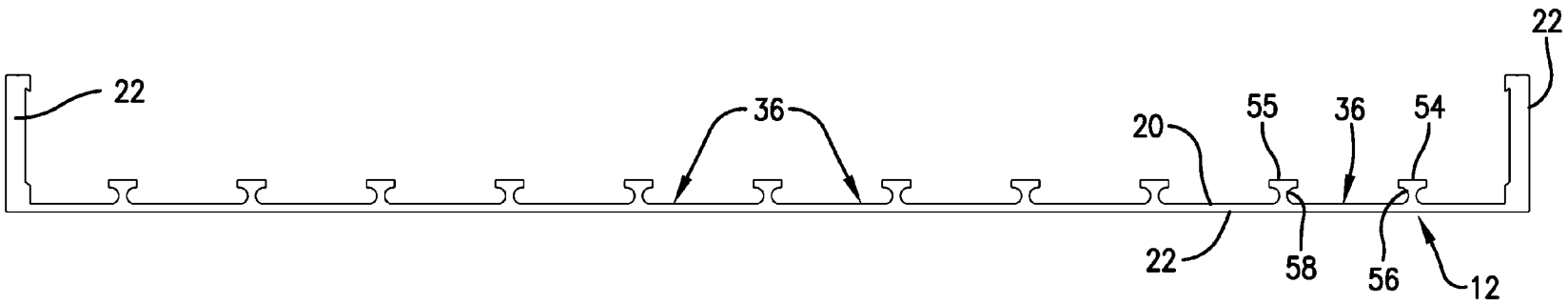
FIG. 20 is a top plan view of a concrete form panel showing a plurality of track systems of the present invention.

In one embodiment, each concrete form panel 12, 14 includes at least one of the track systems 36 oriented in parallel and spaced-apart relationship to one of the siderails 22 and extending all or a majority of the distance between the opposite endrails 24. A second one of the track systems 36 may be similarly positioned in relation to the opposite siderail 22. Additionally or alternatively, each concrete form panel 12 may include one or a pair of such track systems 36 oriented in parallel and spaced-apart relationship with the endrails 24. In other embodiments, at least one track system 36 and in other embodiments such as shown in FIG. 20 multiple track systems 36 may be located at other locations on the rear face 20 of the concrete form panel 12, 14 to allow other types of form hardware to be secured to the concrete form panel 12, 14 at locations other than where the engagement pin mechanisms 34 must be positioned to extend through the apertures 32. The track systems 36 may be formed partly or completely below the surface of the rear face 20 or may be formed partly or completely above the surface of the rear face 20. The track systems 36 may be formed in a various ways, such as an extrusion with a portion of the concrete form panel 12, by removing such as by milling a portion of the concrete form panel 12, or by affixing to the rear face 20 of the concrete form panel 12, 14 using fasteners, adhesives, welding or other means of attachment.

Each track system 36 is positioned on the rear face 20 of the associated concrete form panel 12 or 14 and is configured to receive the base 44 of the engagement pin mechanism 34 or of other form hardware. In one embodiment, the track system 36 includes a pair of L-shaped rails 54, 55 that present parallel grooves 56, 58. The grooves 56, 58 are configured to snuggly receive the parallel flanges 50, 52 of the locking plate 48 to allow for selectively locating and removably securing the engagement pin mechanism 42 on the rear face 20 of the concrete form panel 12 or 14 at a user-selected location along the longitudinal length of the track system 36. In the illustrated embodiment, the rails 54, 55 are welded to the surface of the rear face 20 of the concrete form panel 12, 14, but it is to be understood that they can be attached using fasterners, adhesives or other means of attachment.

Rather than being formed as separate components that are joined to the rear face 20 of the concrete form panel 12, 14, the rails 54, 55 can be formed integrally with the concrete form panel 12, 14 or a subassembly thereof. For example, the rails 54, 55 may be formed as part of an extrusion of a portion of the concrete form panel 12, 14 or by milling away or otherwise removing a portion of the concrete form panel 12, 14.

The rails 54, 55 may have profiles other than the illustrated L-shape profile and in some embodiments, only a single one of the rails 54, 55 is used. Similarly, the base 44 may be formed in a manner to interlock with the single rail 54 or 55, such as by using various types of fasteners such as detents, clips, cotter pins, keys, screws, or bolts. Other means of attachment such as adhesives, welding, riveting or crimping may also be used.

Figure 7:
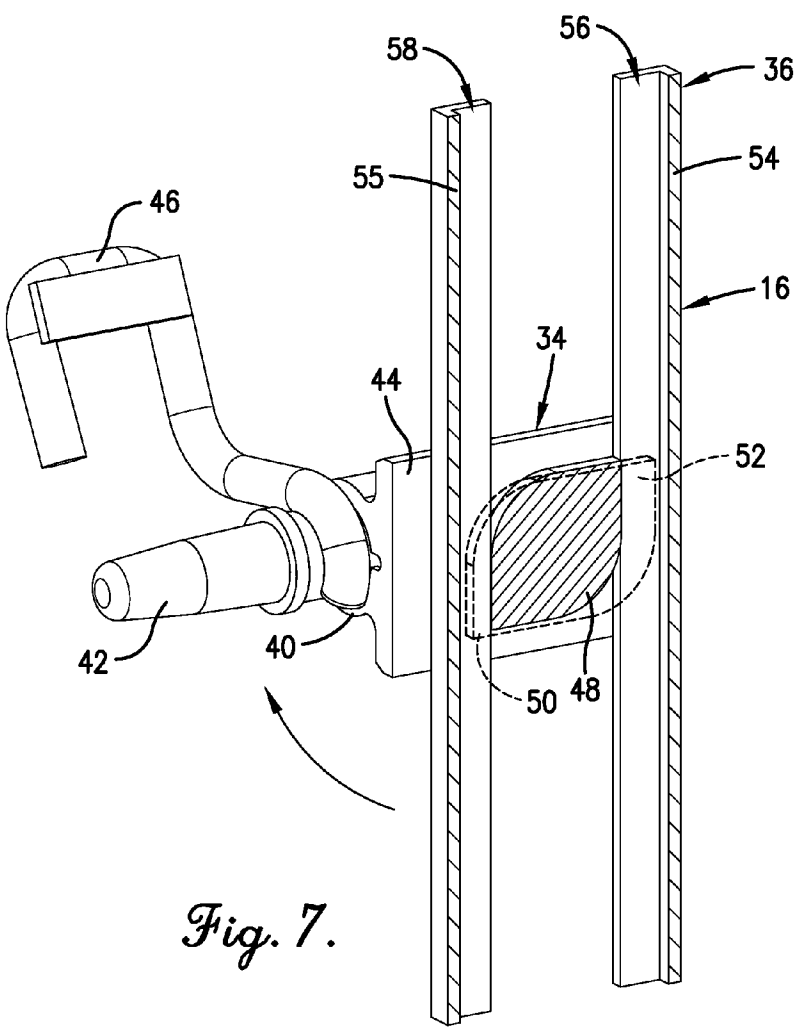
FIG. 7 is a fragmentary perspective view of the concrete form showing the engagement pin mechanism in a second orientation in locking engagement with the track system.
Figure 6:
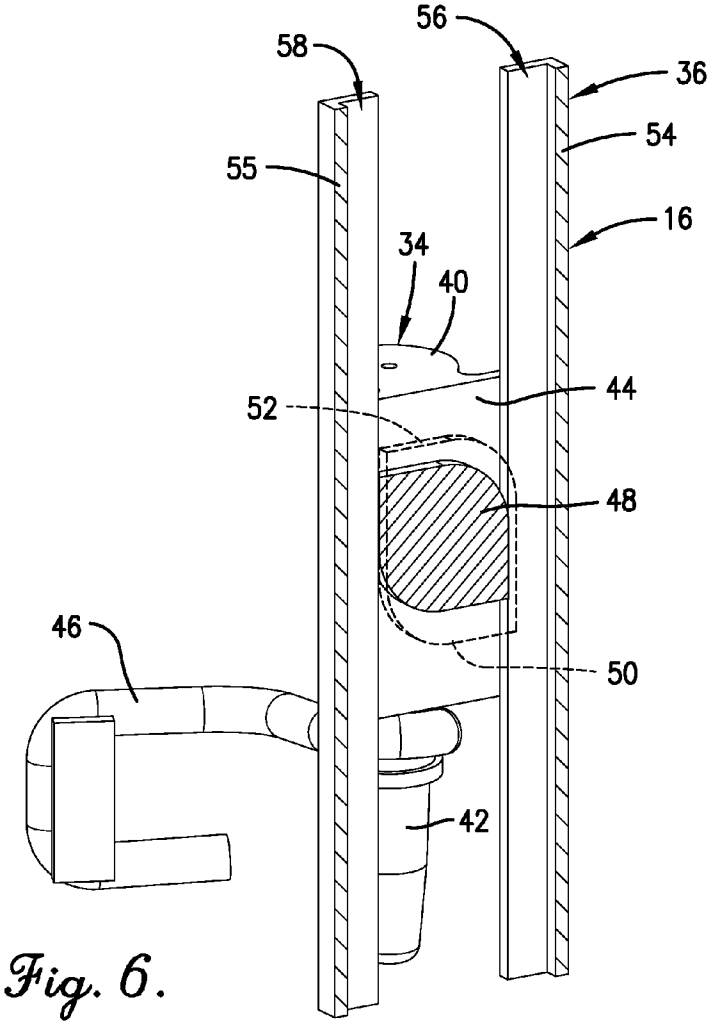
FIG. 6 is a fragmentary perspective view of the concrete form showing the engagement pin mechanism in a first orientation in preparation for being secured with the track system.
Figure 8:
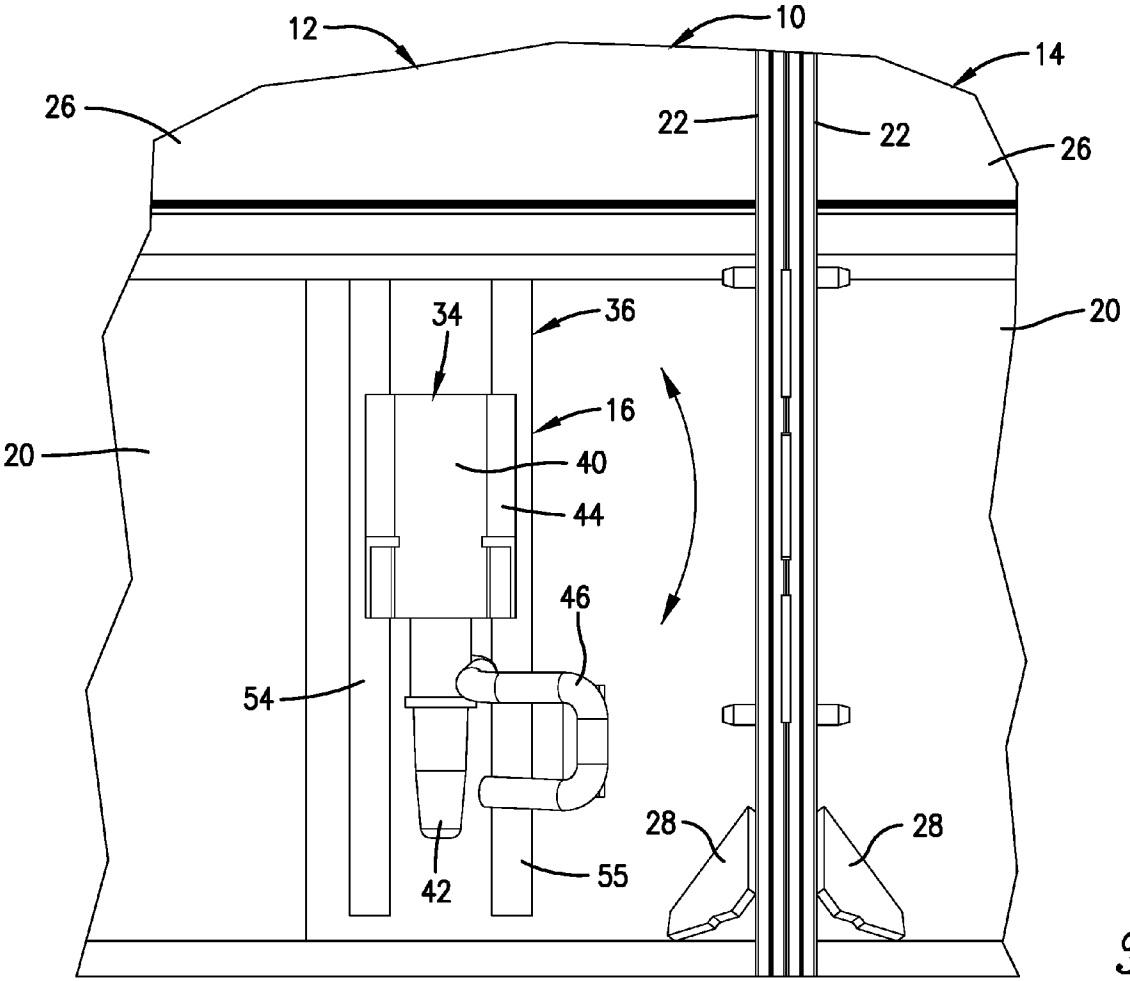
FIG. 8 is a rear elevation view of the concrete form with the engagement pin mechanism oriented in a first position relative to the track system.
Figure 9:
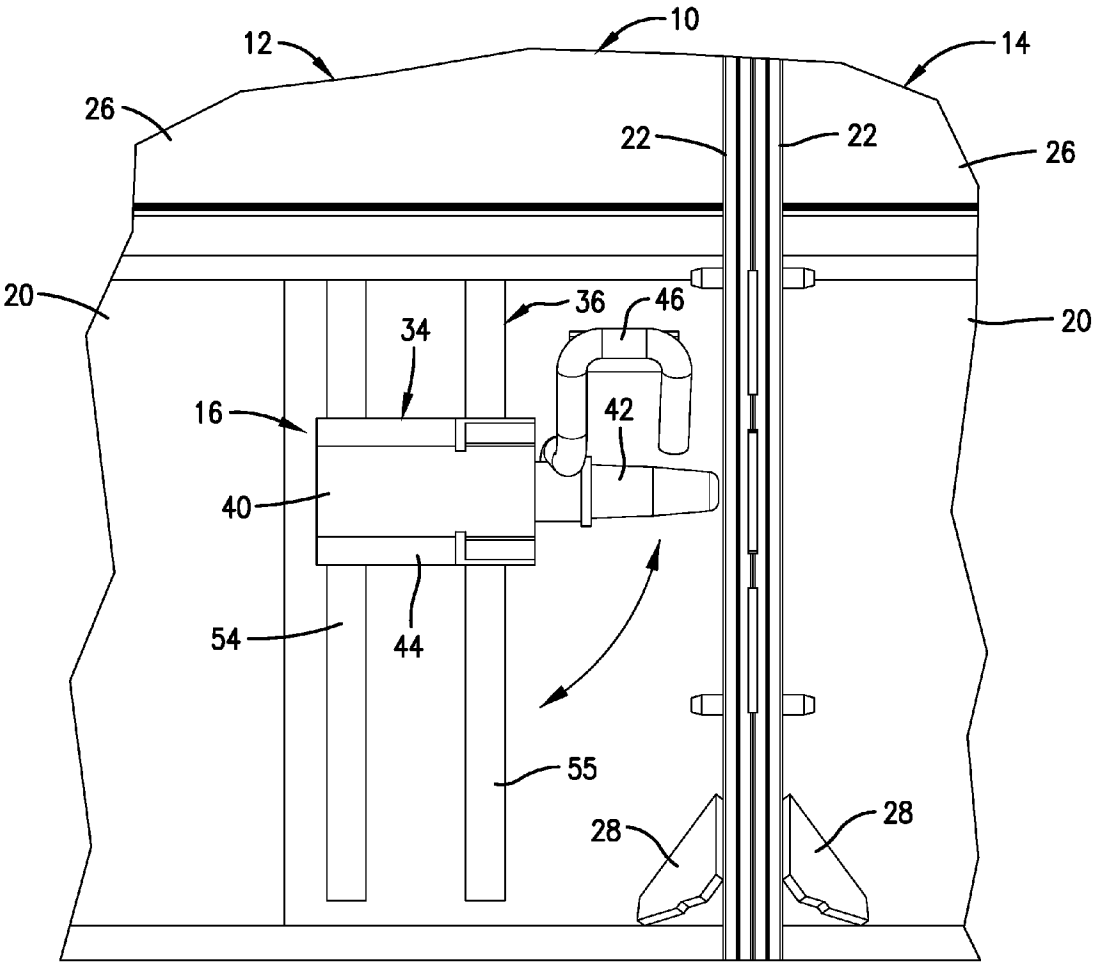
FIG. 9 is a fragmentary rear elevation view of the concrete form showing the engagement pin mechanism in a second position rotated 90° from the orientation shown in FIG. 8 with its engagement pin retracted.

Referring more specifically to FIGS. 7, 8, and 9, the locking plate 48 may be rotatable or otherwise reorientable within the illustrated track system 36 between a first position or orientation shown in FIG. 7 and a second position or orientation shown in FIGS. 8 and 9. In the first position, the locking plate 48 is loosely received within the track system 36 and oriented so that the axis of the bore 47 of the housing is parallel with the longitudinal orientation of the track system 36. When the locking plate 48 is oriented in the first position, the parallel flanges 50, 52 are not received or not fully received within the parallel grooves 56, 58 so that the engagement pin mechanism 42 is not secured with the track system 36. The second position may be achieved by rotating the engagement pin mechanism 42 one-quarter turn (indicated by the arrow) so that the parallel flanges 50, 52 are snugly received within the parallel grooves 56, 58 and the engagement pin mechanism 42 is releasably secured by the track system 36 to the outer surface 20 of the concrete panel form 12 or 14. In the second position, the locking plate 48 is oriented so that the axis of the bore 47 of the housing is perpendicular with the longitudinal orientation of the track system 36 and is aligned with the aperture 32 so that the engagement pin 42 can be extended through the aperture 32.

Referring again to FIG. 3, the locking plate 48 may have substantially any suitable shape, such as a generally polygonal shape (e.g., square or otherwise rectangular). The locking plate 48 may have two or more rounded corners to facilitate rotating the locking plate 48 within the track system 36 between the first and second positions. Additionally or alternatively, each of the parallel flanges 50, 52 of the locking plate 48 may have opposed rounded corners to facilitate rotating the locking plate 48 within the vertical track system 36.

There may be any number of apertures 32 in the siderails 22 and/or endrails 24, and the engagement pin mechanism 42 may be selectively locatable and releasably secureable in the track system 36 to align with any one of the apertures 32. In one implementation, the apertures 32 may be reinforced with bushings.

Figure 10:
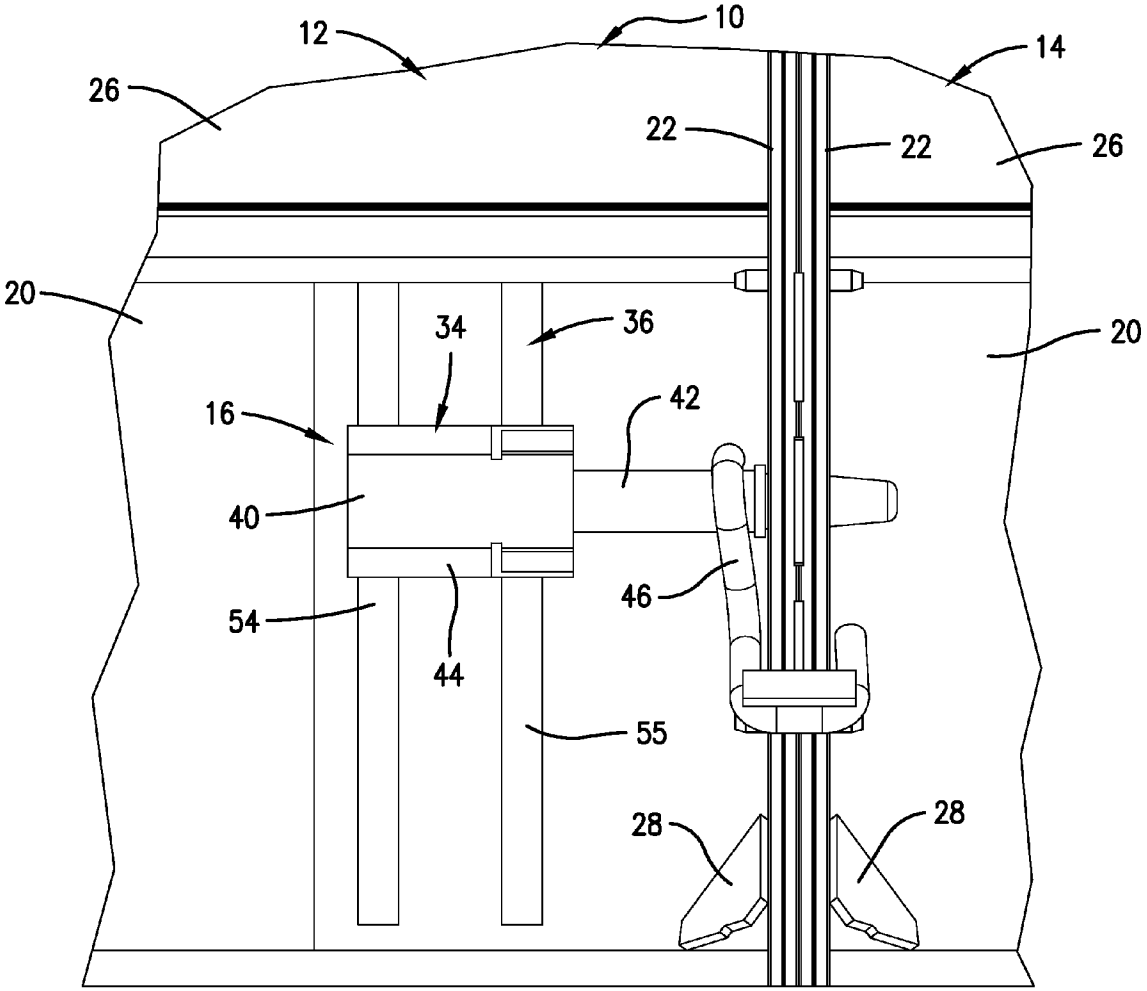
FIG. 10 is a fragmentary rear elevation view of the concrete form showing the engagement pin mechanism in the second position shown in FIG. 9, but with the engagement pin extended and its latch engaged to secure the adjacent concrete form panels together.
Figure 11:
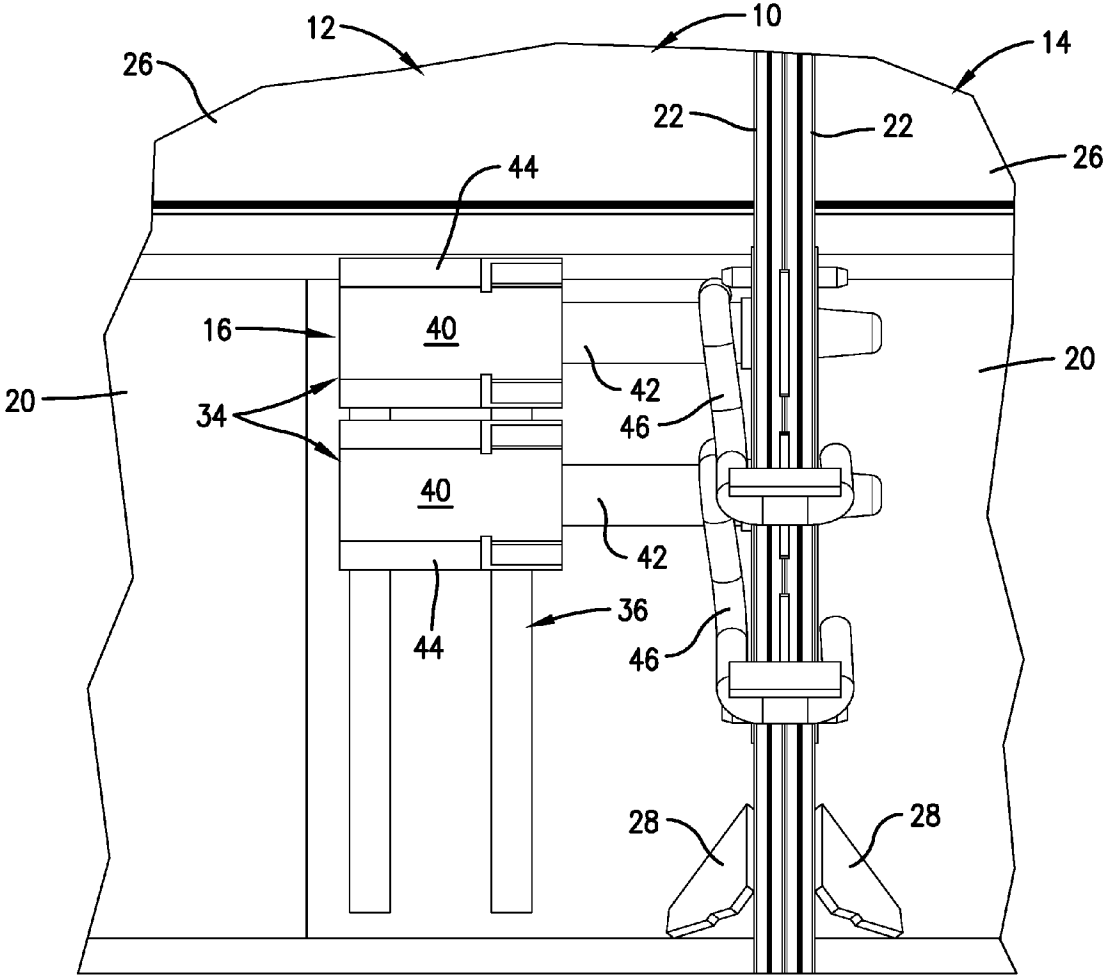
FIG. 11 is a fragmentary rear elevation view of the concrete form showing adjacently-located first and second engagement pin mechanisms securing the first and second concrete panels together.

Alternatively or additionally, referring to FIGS. 10 and 11, the apertures 32 may be arranged in clusters (e.g., two, three, or four) of closely spaced-apart adjacent apertures 32, and a first engagement pin mechanism 42 may be alignable with a first aperture of a such a cluster, and a second engagement pin mechanism 42 may be alignable with a second aperture of such a cluster, such that the first and second engagement pin mechanisms 42 are located adjacent to each other.

In one implementation, the track system 36 may be manufactured separately from and then physically attached such as be bolting or welding to the outer surface 20 of the concrete form panel 12 or 14. In another implementation, the track system may be manufactured as an integral part of the concrete form panel 12 or 14. For example, each of the opposed side portions of the concrete form panel 12 or 14 may be formed as an extrusion containing the track system and the siderail 22. The two side portions can then be joined with a central face sheet to form the concrete form panel 12 or 14.

In place of the engagement pin mechanism 42, other form hardware components may be provided with a same or similar locking plate 48 in order to be similarly selectively locatable and releasably secureable in the track system 36. Such other components may include, for example, striker plates to protect the siderails 22 and/or endrails 24 against blows from hammers, various types of brackets and attachments for scaffold supports, wall braces, lanyards, pins and the like. The form hardware components may also be used with other types of bases that interlock with the track system 36.

Figure 12:
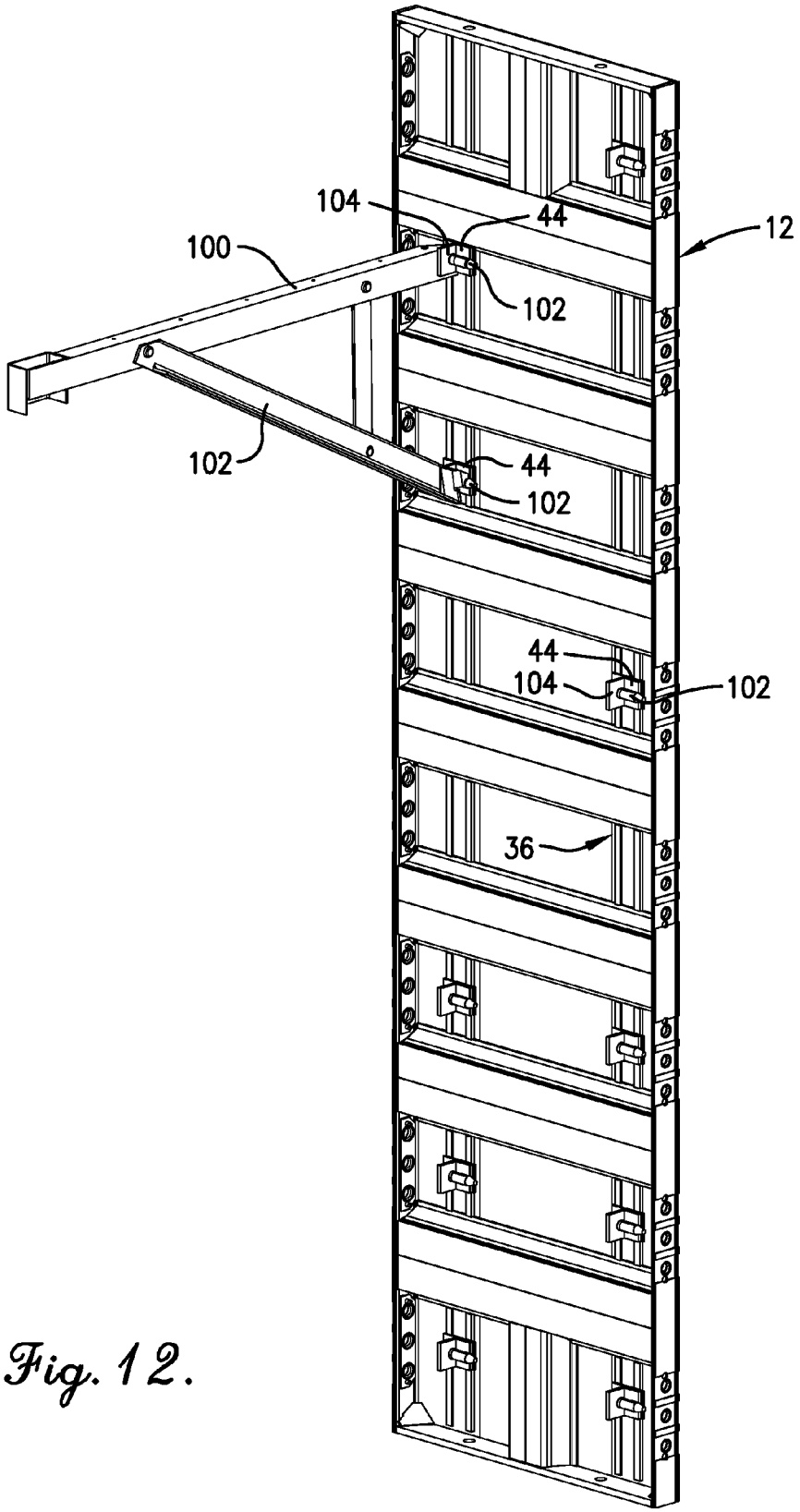
FIG. 12 is a fragmentary rear perspective view of one of the concrete form panels showing a scaffold support attached to the track system by a pair of brackets.
Figure 13:
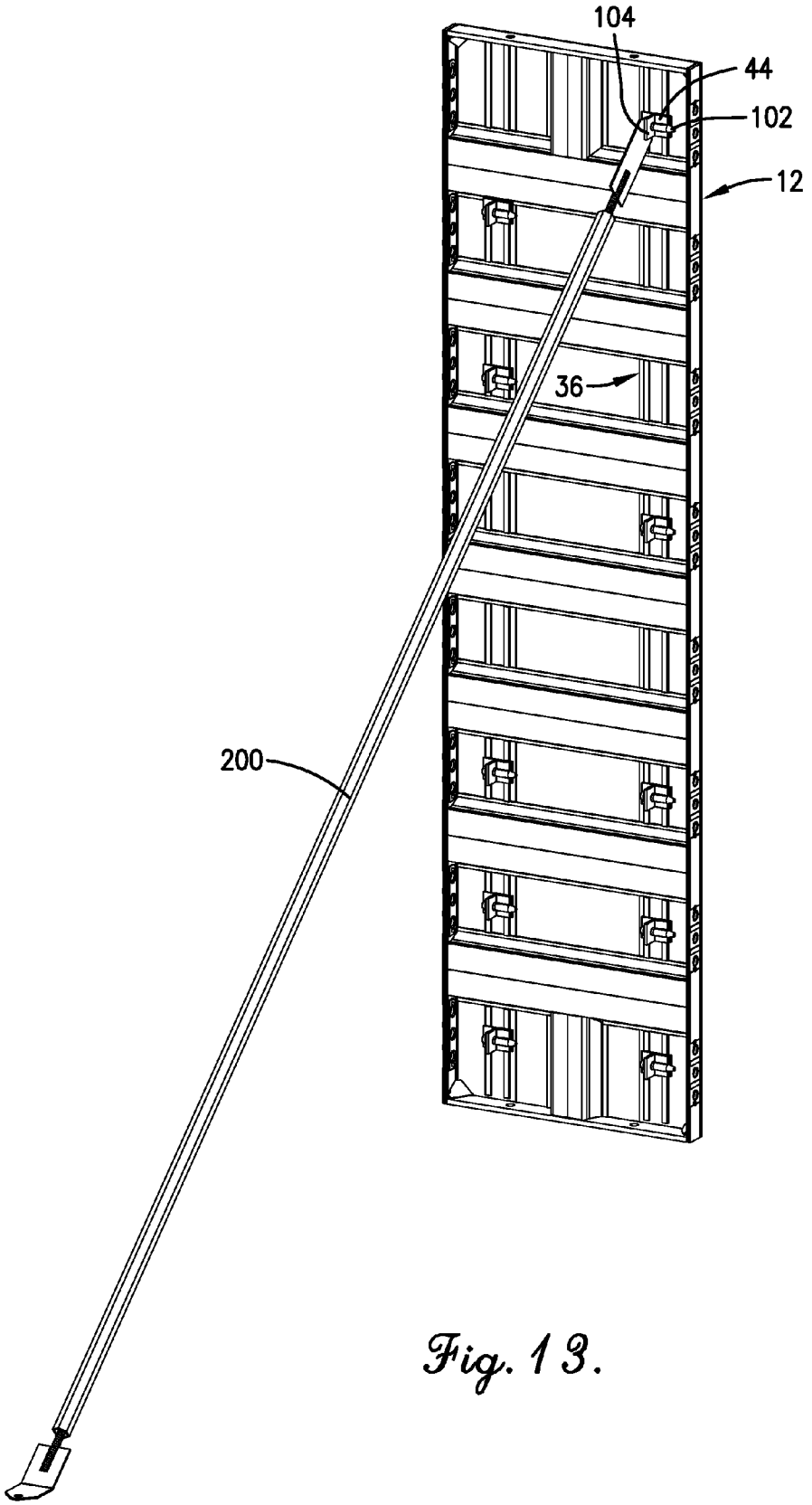
FIG. 13 is a fragmentary rear perspective view of one of the concrete form panels showing a wall brace attached to the track system by a bracket.
Figure 14:
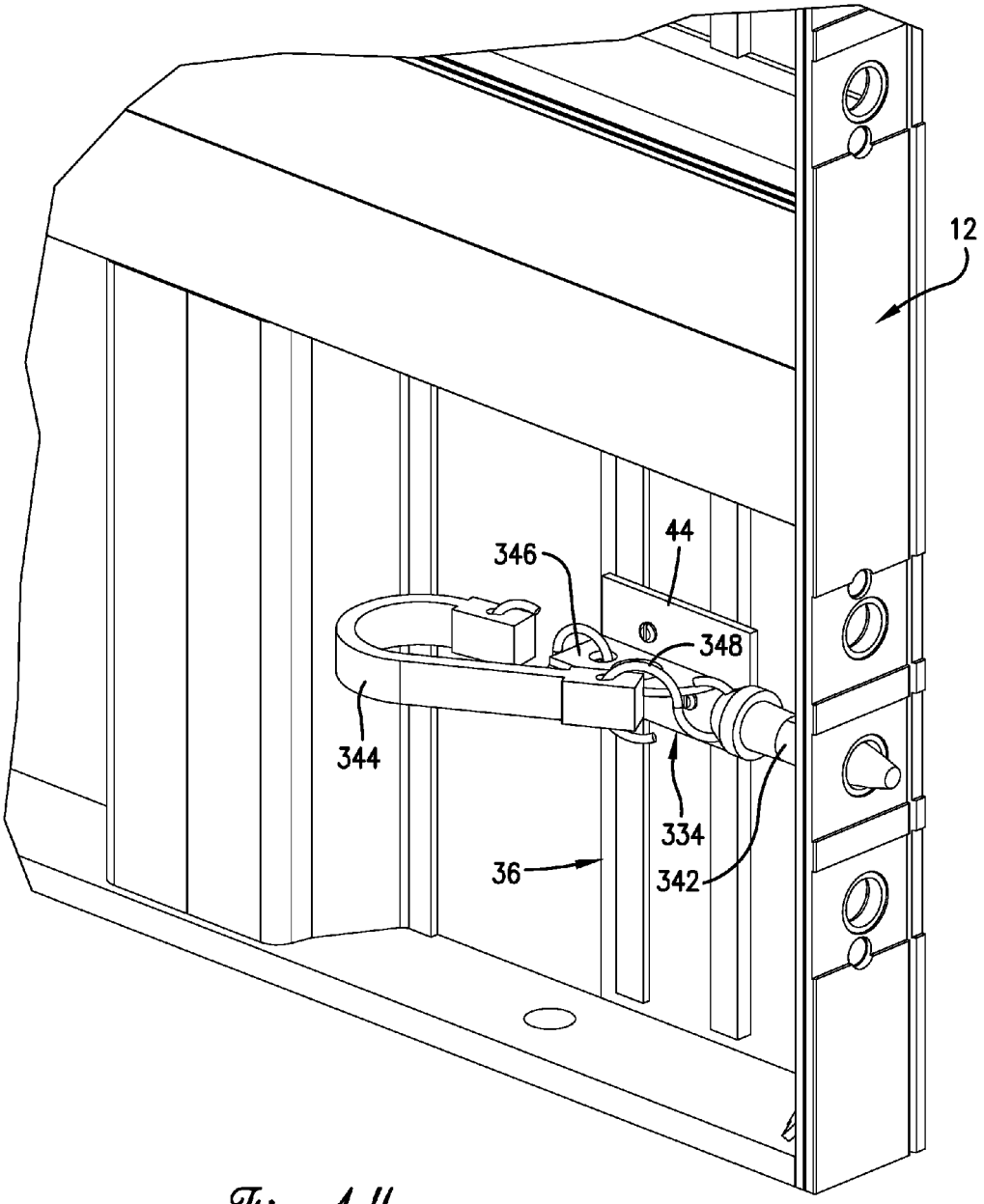
FIG. 14 is a fragmentary rear perspective view of one of the concrete form panels showing another embodiment of an engagement pin mechanism in locking engagement with the track system.
Figure 15:
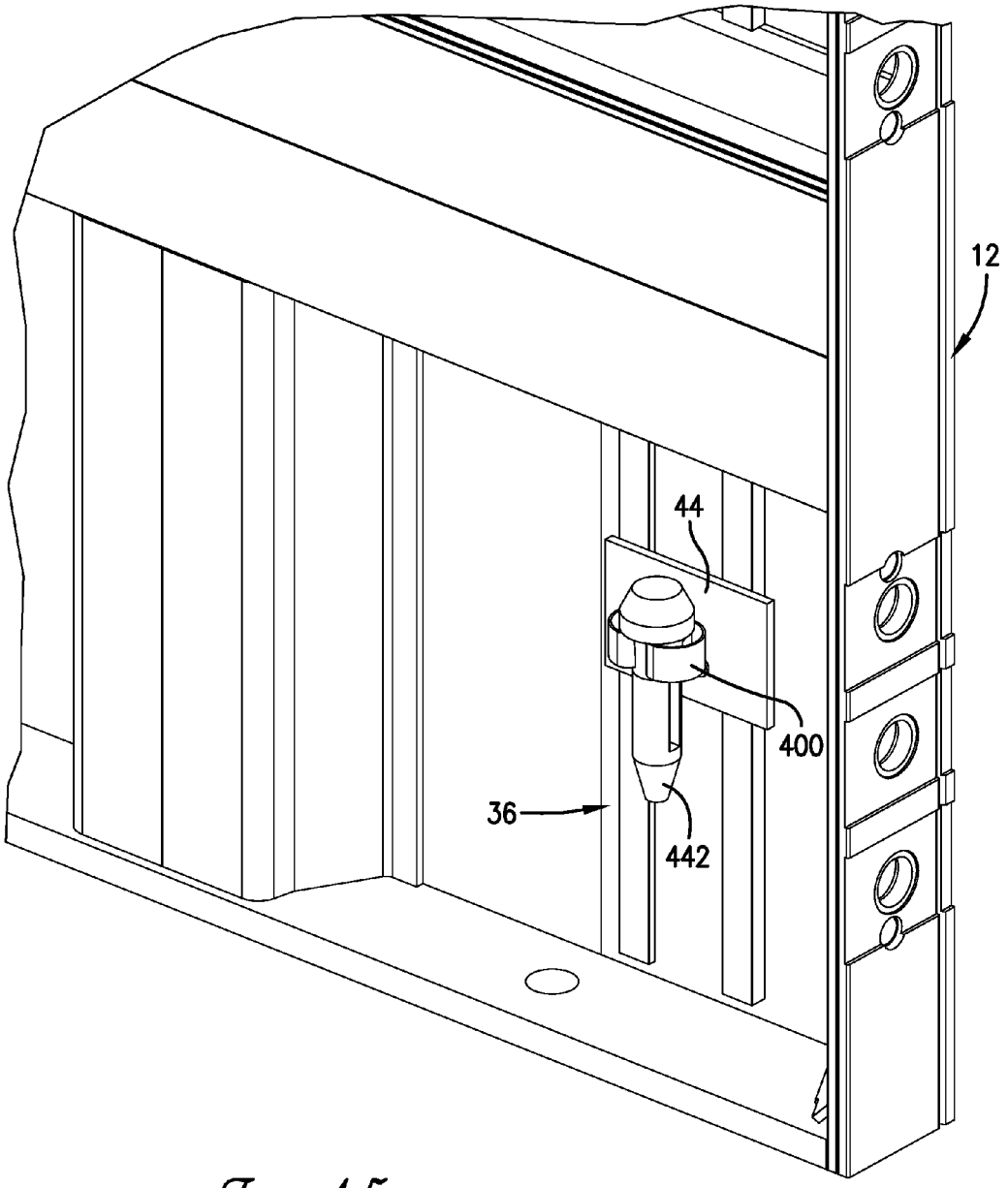
FIG. 15 is a fragmentary rear perspective view of one of the concrete form panels showing a bracket in locking engagement with the track system and hold a pin.

Examples of other types of form hardware components that may be connected to the rear face 20 of the concrete form panel 12, 14 using the fastening system 16 are illustrated in FIGS. 12-19. In FIG. 12, a scaffold support 100 and brace 102 are each separately attached to a pin 102 mounted on a flange 104 that extends from the base 44. Each base 44 is interlocked with the track system 36, such as in the manner previously described. In FIG. 13, a wall brace 200 is similarly attached to pin 102 that is mounted on the flange 104 extending from base 44. In FIG. 14, another embodiment of an engagement pin mechanism is shown and is designated by the numeral 334. The engagement pin mechanism 334 includes an engagement pin 342 that is connected to one end of a flexible tether 344. The other end of the tether 344 is connected to a flange 346 that extends from the base 44. The flange 346 includes a storage aperture 348 in which the engagement pin 342 is inserted for storage when the concrete form panel 12, 14 is being transported and stored. In FIG. 15, a clip 400 is attached to the base 44 and may be used for storing the engagement pin 442 during transportation and storage of the concrete form panel 12, 14.

Figure 16:
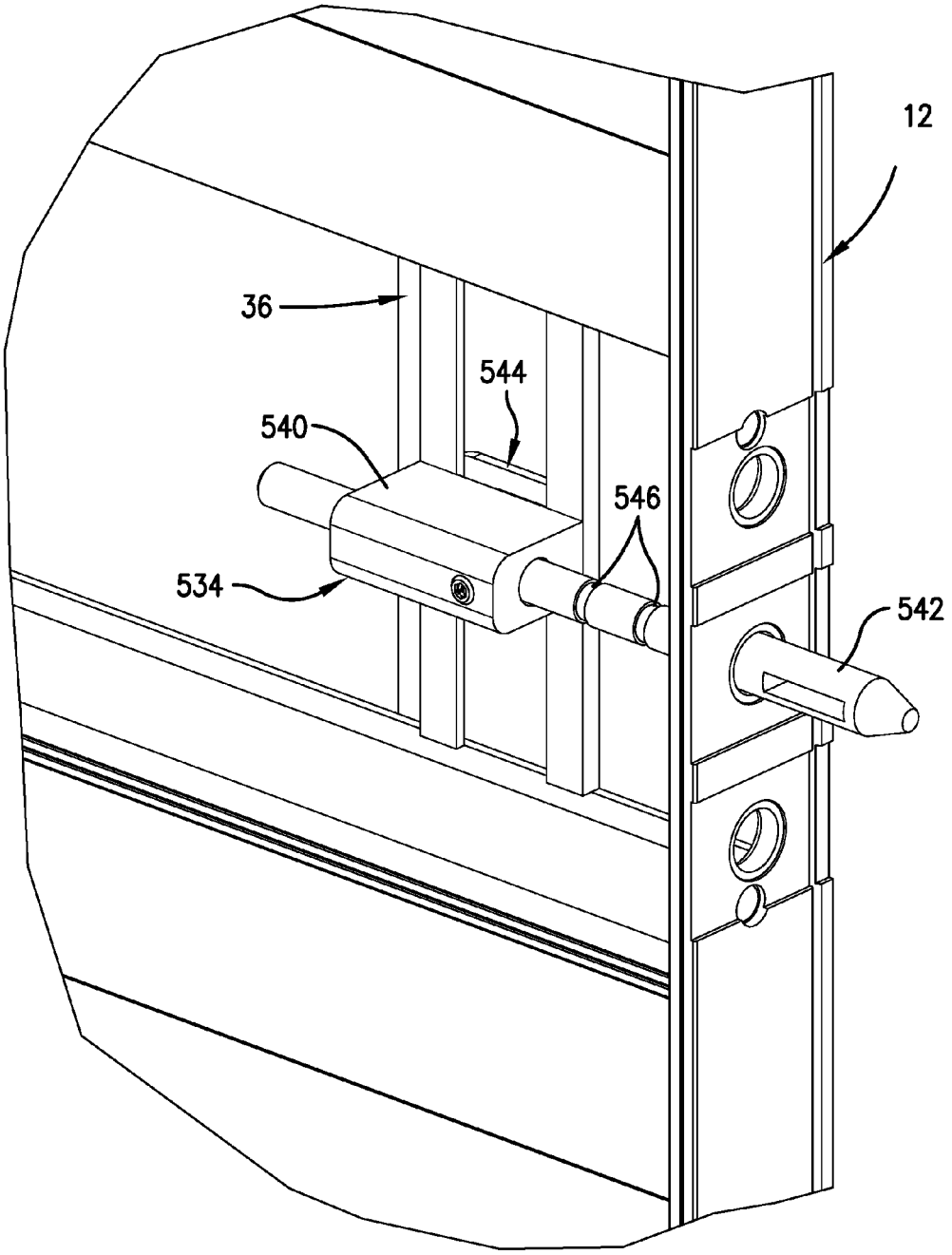
FIG. 16 is a fragmentary rear perspective view of one of the concrete form panels showing a further embodiment of an engagement pin mechanism in locking engagement with the track system.

A further embodiment of an engagement pin mechanism 534 is illustrated in FIG. 16 and comprises a housing 540 and an engagement pin 542 that is slidably received with a bore 547 formed in the housing 540. The housing 540 includes a base 544 that is interconnected with the track system 36. A series of detents 546 is formed on the engagement pin 542 and cooperate with a mechanism within the housing 540 to retain the engagement pin 542 at preselected extended positions.

Figure 17:
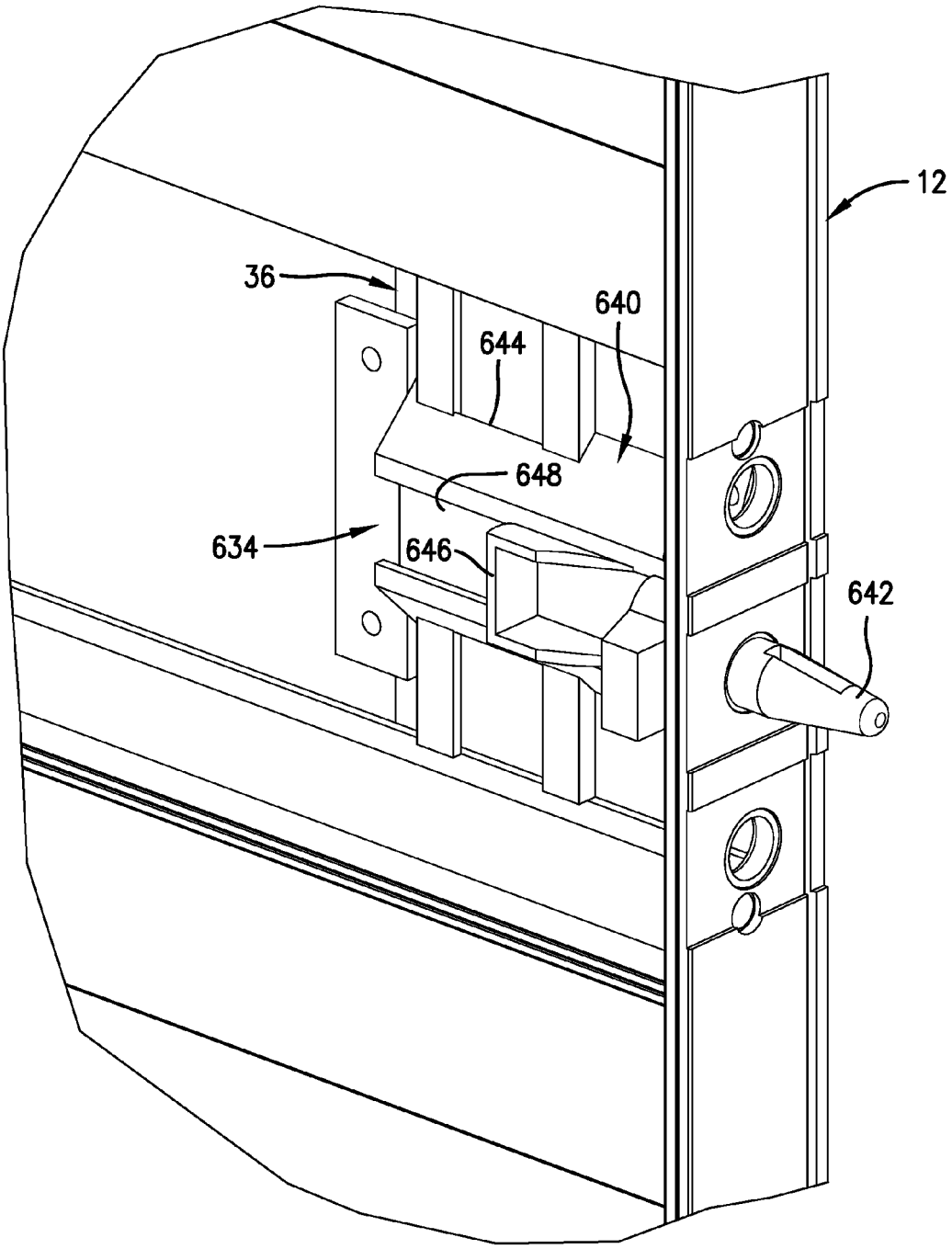
FIG. 17 is a fragmentary rear perspective view of one of the concrete form panels showing a still further embodiment of an engagement pin mechanism in locking engagement with the track system

A still further embodiment of an engagement pin mechanism 634 is illustrated in FIG. 17 and comprises a housing 640 and an engagement pin 642. The housing 640 includes a base 644 that interlocks with the track system 36 in a manner that permits only sliding motion of the base 644 along a portion of the longitudinal length of the track system 36. The base 644 is interlocked with the track system 36 by sliding onto the track system 36 during assembly of the concrete panel form 12, 14. Once the concrete panel form 12, 14 has been assembled, the base 644 is captured by track system 36. The engagement pin 642 is itself mounted to a slide 646 that travels along a channel 648 on the housing 640 to permit extension of the engagement pin 642 through the apertures 32 in the siderails 22 or the endrails 24.

Figure 18:
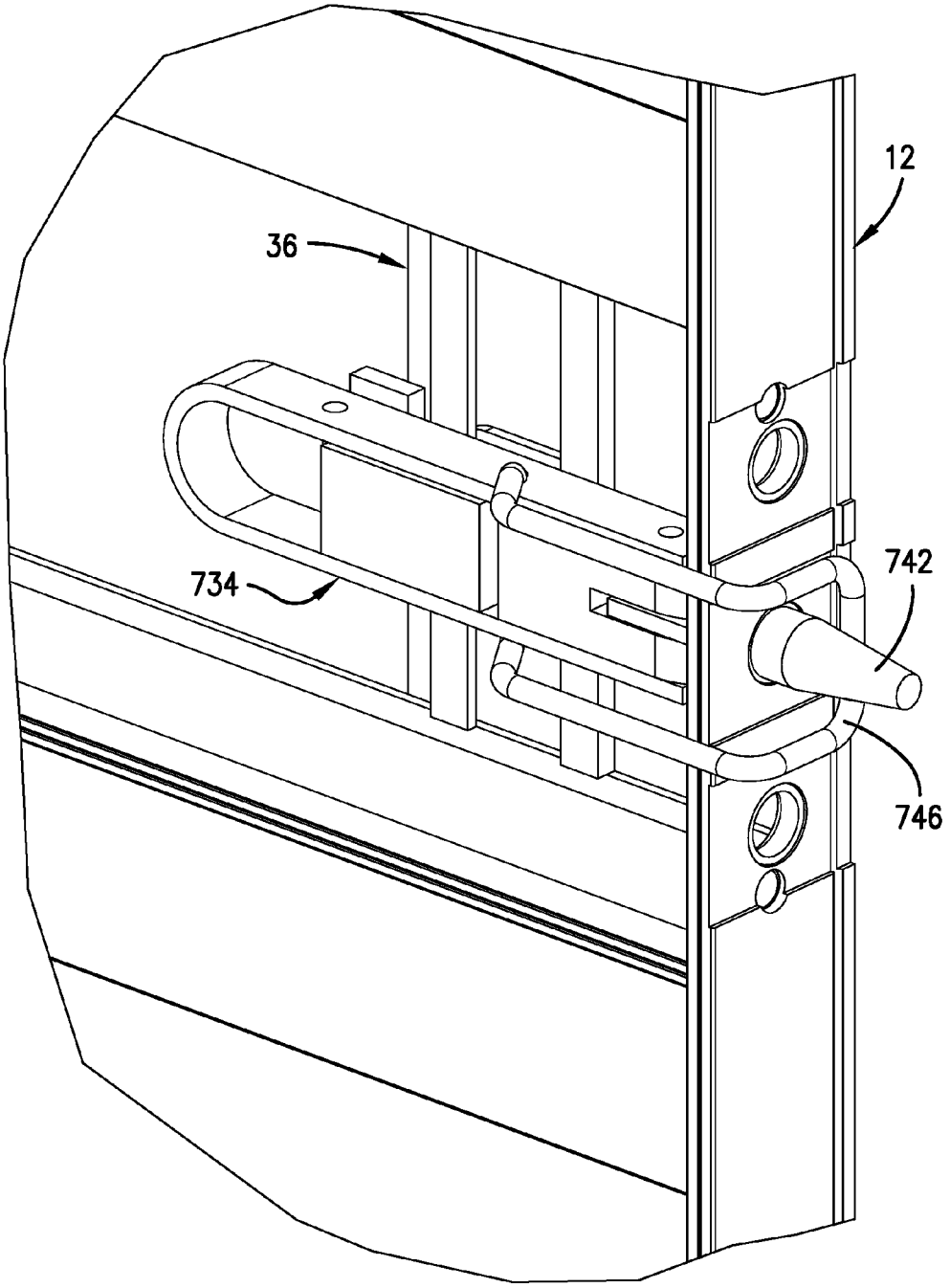
FIG. 18 is a fragmentary rear perspective view of one of the concrete form panels showing yet another embodiment of an engagement pin mechanism in locking engagement with the track system.

Another embodiment of an engagement pin mechanism 734 is shown in FIG. 18 and is mounted for sliding movement along the track system 36 in a manner similar to engagement pin mechanism 634. The engagement pin mechanism 734 includes an engagement pin 742 and a latch 746 that serves the same purpose as latch 46 described above.

Figure 19:
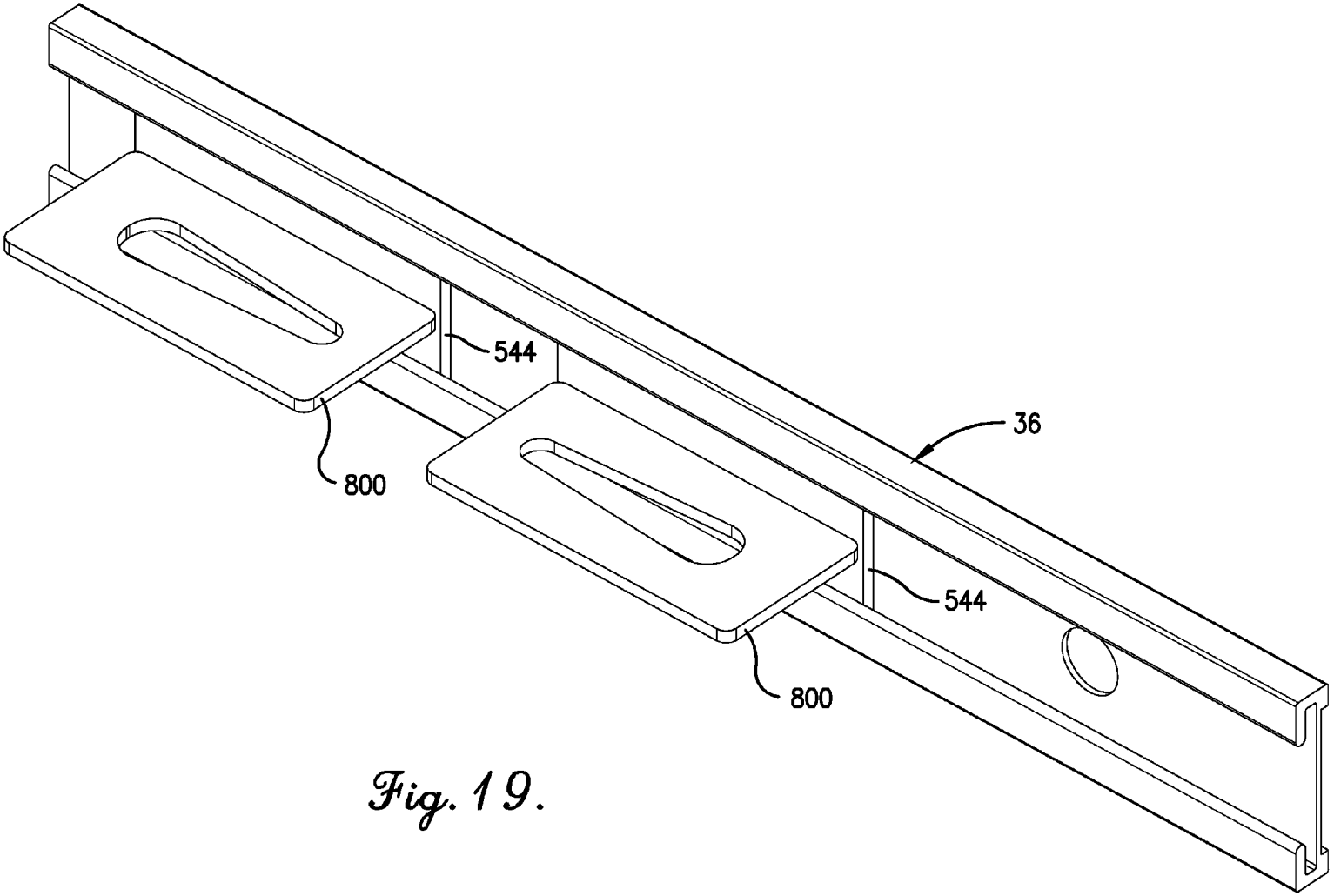
FIG. 19 is a fragmentary rear perspective view of the track system showing a pair of lanyard attachments.

In FIG. 19, a flange 800 for attachment of lanyard clip extends from a base 544 that is captured by and is slidable along the track system 36. The base 54 is normally inserted into the track system 36 during assembly of the concrete form panel 12, 14. The base 54 can be secured into a fixed positioned along the track system 36 in various ways, including by welding, adhesives, crimping the track system, or using fasteners.

Thus, the present invention provides substantial advantages over the prior art, including that it allows for greater flexibility in locating the engagement pin mechanisms or other form hardware, including allowing for quickly and easily relocating the engagement pin mechanisms or other form hardware wherever they may be needed, providing multiple adjacent engagement pin mechanisms wherever they may be needed, and moving engagement pin mechanisms in order to relocate internal form ties up or down to clear rebar, electrical, or plumbing materials.

Although the invention has been described with reference to the one or more embodiments illustrated in the figures, it is understood that equivalents may be employed and substitutions made herein without departing from the scope of the invention as recited in the claims.

The invention claimed is:

1. A fastening system for fastening a concrete form panel to an adjacent concrete form panel, wherein the concrete form panel has a siderail or endrail presenting an aperture, the fastening system comprising:

an engagement pin mechanism including— an engagement pin configured to selectively extend through the aperture to fasten the concrete form panel to the adjacent concrete form panel, and a base associated with the engagement pin, the base having a locking plate, the locking plate having a flange which is oriented perpendicular to an axis of the engagement pin; and a track system associated with an outer surface of the concrete form panel and extending parallel to and spaced apart from the siderail or endrail, the track system having a groove, the groove being configured to receive the flange of the locking plate to thereby secure the engagement pin mechanism in a location on the track system such that the engagement pin is positioned to extend through the aperture in the siderail or endrail, wherein the locking plate is reorientable within the track system such that— in a first orientation, the engagement pin mechanism is not secured in the location on the track system, and in a second orientation, the flange is tightly received within the groove so that the engagement pin mechanism is secured in the location on the track system.

2. The fastening system as set forth in claim 1, wherein the locking plate has a polygonal shape with a rounded corner to facilitate repositioning the locking plate between the first and second positions within the track system.

3. The fastening system as set forth in claim 1, wherein there are a plurality of apertures in the siderail or endrail, and the engagement pin mechanism is selectively locatable and reorientably securable within the track system so that the engagement pin is positioned to extend through any aperture of the plurality of apertures.

4. The fastening system as set forth in claim 1, wherein the track system is physically attached to the outer surface of the concrete form panel.

5. The fastening system as set forth in claim 1, wherein the track system is an extruded portion of the concrete form panel.

* * * * *